US010550352B2

(12) United States Patent
Hewitt et al.

(10) Patent No.: US 10,550,352 B2
(45) Date of Patent: Feb. 4, 2020

(54) METHOD AND APPARATUS FOR PRESSING OILSEED TO EXTRACT OIL THEREFROM

(71) Applicant: University of Ulster, Coleraine (GB)

(72) Inventors: Neil James Hewitt, Carrickfergus (GB); Marcio Fernandes Novaes, Lisburn (GB)

(73) Assignee: University of Ulster, Coleraine (GB)

( * ) Notice: Subject to any disclaimer, the term of this patent is extended or adjusted under 35 U.S.C. 154(b) by 350 days.

(21) Appl. No.: 15/300,580

(22) PCT Filed: Mar. 31, 2015

(86) PCT No.: PCT/EP2015/057134
§ 371 (c)(1),
(2) Date: Sep. 29, 2016

(87) PCT Pub. No.: WO2015/150433
PCT Pub. Date: Oct. 8, 2015

(65) Prior Publication Data

US 2017/0107447 A1 Apr. 20, 2017

(30) Foreign Application Priority Data

Apr. 2, 2014 (GB) ..... 1405975.2

(51) Int. Cl.
*C11B 1/10* (2006.01)
*C11B 1/04* (2006.01)
(Continued)

(52) U.S. Cl.
CPC ..... *C11B 1/102* (2013.01); *B30B 15/34* (2013.01); *C11B 1/02* (2013.01); *C11B 1/04* (2013.01); *C11B 1/06* (2013.01)

(58) Field of Classification Search
CPC ..... C11B 1/02; C11B 1/102
See application file for complete search history.

(56) References Cited

U.S. PATENT DOCUMENTS 2,332,829 A * 10/1943 Parsons ..... B29C 47/0004 264/108
2,610,033 A * 9/1952 Rietz ..... F28D 11/02 165/87
(Continued)

FOREIGN PATENT DOCUMENTS

CN 202623330 U 12/2012
GB 245774 1/1926
(Continued)

OTHER PUBLICATIONS

International Search Report and Written Opinion dated Jul. 24, 2015 for International Application Serial No. PCT/EP2015/057134, International Filing Date: Mar. 31, 2015, consisting of 9 pages.
(Continued)

*Primary Examiner* — Shelley M Self
*Assistant Examiner* — Jared O Brown
(74) *Attorney, Agent, or Firm* — Christopher & Weisberg, P.A.

(57) ABSTRACT

A method of extracting oil from oilseed comprising pressing seeds within a screw press including a screw auger rotatably mounted within a cylindrical expeller body, wherein the expeller body comprises a feed section, a compression section, and a discharge section, wherein at least one outlet is provided in the expeller body, preferably in or adjacent the feed section of the expeller, said method comprising the step of controlling the temperature of at least the compression section of the expeller by means such that the temperature of the material within the compression section does not exceed the glass transition temperature of the seeds.

32 Claims, 6 Drawing Sheets

SECTION A-A

(51) Int. Cl.

| | |
|---|---|
| ***C11B 1/06*** | (2006.01) |
| ***B30B 15/34*** | (2006.01) |
| ***C11B 1/02*** | (2006.01) |

(56) References Cited

U.S. PATENT DOCUMENTS 2,702,408 A * 2/1955 Hartland ..... B29C 47/12 264/211.21
3,518,936 A * 7/1970 Bredeson ..... B30B 9/12 100/117
3,552,304 A * 1/1971 French ..... C13B 10/04 100/139
3,555,998 A * 1/1971 Meakin ..... B30B 11/24 100/339
3,814,566 A * 6/1974 Stroup ..... B29C 47/0004 264/29.1
3,843,290 A * 10/1974 Sender ..... B29C 48/92 425/208
3,939,763 A * 2/1976 Sato ..... B30B 9/121 100/340
3,950,118 A * 4/1976 Adair ..... B29C 47/86 425/144
4,373,434 A * 2/1983 Alexander ..... B30B 9/18 100/117
4,452,744 A * 6/1984 Finch ..... C11B 1/06 554/23
4,621,678 A * 11/1986 Hahn ..... B29C 35/007 165/263
4,830,595 A * 5/1989 Bentivoglio ..... B29C 47/0026 219/201
4,901,635 A * 2/1990 Williams ..... B30B 9/12 99/483
5,169,968 A 12/1992 Rice
5,290,959 A 3/1994 Rice
5,346,713 A * 9/1994 Leader ..... B30B 11/22 426/454
5,351,612 A * 10/1994 Kemper ..... B30B 9/12 100/129
5,476,550 A 12/1995 Walker
5,567,369 A * 10/1996 Beckwith ..... B29C 44/465 264/209.7
5,680,812 A * 10/1997 Linsgeseder ..... A23N 1/00 100/148
5,707,673 A * 1/1998 Prevost ..... C11B 1/104 210/634
6,887,509 B2 * 5/2005 Leusner ..... B02B 1/08 426/507
7,296,991 B2 * 11/2007 Irwin ..... B29C 48/30 425/381
2009/0186136 A1 * 7/2009 Lindeboom ..... A23J 1/142 426/430

FOREIGN PATENT DOCUMENTS

GB 592117 A * 9/1947 ..... B30B 9/12
GB 2343898 A 5/2000
GB 2485814 A 5/2012
WO 96/22705 A1 8/1996
WO 02/20705 A1 3/2002

OTHER PUBLICATIONS

United Kingdom Search Report dated Dec. 9, 2014 for corresponding United Kingdom Application Serial No. 1405975.2, United Kingdom Filing Date: Apr. 2, 2014, consisting of 3 pages.
Evon et al., "New Renewable and Biodegradable Particleboards from Jatropha Press Cakes", Journal of Renewable Materials, vol. 2, No. 1, Mar. 2014 (Mar. 2014), pp. 52-65, XP002742137, ISSN: 2164-6341.

* cited by examiner

METHOD AND APPARATUS FOR PRESSING OILSEED TO EXTRACT OIL THEREFROM

CROSS-REFERENCE TO RELATED APPLICATIONS

This application is a Submission under 35 U.S.C. § 371 for U.S. National Stage Patent Application of, and claims priority to, International Application Number PCT/EP2015/057134, filed Mar. 31, 2015, entitled "A METHOD AND APPARATUS FOR PRESSING OILSEED TO EXTRACT OIL THEREFROM", which is related to and claims priority to United Kingdom Patent Application Number 1405975.2, filed Apr. 2, 2014, the entire contents of both of which are hereby incorporated herein by reference.

FIELD OF THE INVENTION

This invention relates to a method and apparatus for pressing oilseed to extract oil therefrom.

BACKGROUND OF THE INVENTION

Vegetable oils, such as rapeseed oil, are increasingly being considered as renewable fuel sources providing an alternative to fossil fuels.

Such oils can to be extracted from the seed material (oilseed) using mechanical presses (often referred to as expellers), chemical processes, or a combination of both. The chemical process (solvent extraction) is highly efficient but capital intensive and it is also considered unsafe due to the use of flammable chemical solvents. Solvent extraction is used in operations that process many tons of oilseed per hour, while mechanical presses are used for processing oilseeds in the order of kilograms per hour up to several hundreds of kilograms per hour.

Mechanical presses are quite simple in construction, but far less efficient in terms of oil extraction when compared to solvent extraction and, as a result, a large percentage of the vegetable oil is left in the press cake (the solid residue after the pressing process). Typical residual oil content in the press cake from modern commercial expellers is between 8% and 12%. The residual oil is considered a financial loss to an oilseed processer as it normally does not add to the monetary value of the press cake (typically used as animal feed). Therefore increasing the efficiency of a mechanical press can increase the profitability of a small to median size vegetable oil extraction operation.

Mechanical presses for the recovery of oil from oil seed, otherwise known as expellers, are typically used for recovering vegetable oils in two ways;

a) as a high pressure operation leading to maximum oil recovery and consequently low residual oil in the press-cake, or b) as a pre-press operation prior to solvent extraction.

In a pre-press operation, the expeller operates at a relatively low pressure in order to produce a press-cake with high porosity to facilitate the solvent percolation during the follow up solvent extraction. Therefore, maximum oil extraction is not the main goal of a pre-press operation. In a pre-press operation, the press-cake leaves the expeller with a residual oil content of about 20% by weight.

However, in the full press operation, the aim is to extract the maximum amount of the available oil in the oilseed. Therefore, in the full press operation, the expeller operates at a relatively high pressure in order to produce a press-cake with the minimum amount of residual oil therein.

A typical expeller generally comprises a screw auger rotatably mounted within a cylindrical expeller barrel. The expeller is typically divided into three sections, namely a feed section, a compression section, and a discharge section.

The feed section is at the beginning or root end of the screw auger and incorporates an opening in the side wall of the expeller barrel into which seeds can be gravity fed on demand, or in some cases, under pressure by an auxiliary feed gear (force fed expellers). In the feed section, the screw auger transports the seeds towards the compression section.

In compression section the screw auger is shaped to compress and break up the cell walls of the seeds to extract the oil therefrom. The expeller barrel includes a draining area were the oil can flow out of the expeller barrel via oil outlet channels formed in the side wall thereof. In such prior art expellers, the draining area is typically at or adjacent the discharge section of the expeller.

The discharge section includes a press cake outlet, and is commonly defined by an expeller die mounted on or integrally formed with a discharge end of the expeller barrel. The expeller die comprises narrowing tapered inner walls having a relatively narrow outlet opening at an end (known as a die land) thereof through which the press cake is extruded.

During operation of the expeller, a column or plug of compressed meal (press cake) is formed in the discharge section of the expeller, while new seed material is rammed into the compression section by the action of the screw auger in the feed section. New cake is constantly formed at the inner end of the discharge section as the pressed cake is constantly discharged through the outlet opening of the discharge section. The operation may proceed continuously by a constant addition of seed material at the feed section.

The shape of the screw auger has to be designed in a way to be able to cause a higher volume displacement at the feed section compared to the volume displacement at the discharge section, such that the material is compressed as it is conveyed down the expeller barrel. The seed material is subject to increasing axial and radial pressure as it is conveyed from the feed section to the discharge section and the resulting pressure causes the oil to be expelled from the oilseed cells. The expelled oil exits the expeller barrel via the oil outlet channels in the draining area adjacent the discharge end of the expeller barrel.

Various attempts to improve the oil recovery efficiency of mechanical expellers have been made in the past by academic researchers (Vadke & Solsulski, 1988, Isobe et al, 1992, Dufaure et al., 1999, Singh & Bargale, 1999, Kartika & Rigal, 2005, Olayanju et al, 2006, Mpagalile et al, 20007, Evon et al., 2007, Voges et al, 2008, Singh et al, 2010, Deli et al 2011) and by the expeller manufactures themselves. Most of the developments have been concentrated in the design of the expeller screw. Attempts to improve the expeller efficiency have been made by changing the screw configuration (single stage, double stage, worm design, etc.) or by adding an extra counter rotating screw (twin screw expellers).

An object of the present invention is to provide a screw press and method of operation that overcomes the problems of the prior art and maximises oil extraction.

SUMMARY OF THE INVENTION

According to a first aspect of the present invention there is provided method of extracting oil from oilseed comprising pressing seeds within a screw press including a screw auger rotatably mounted within a cylindrical expeller body, wherein the expeller body comprises a feed section, a compression section, and a discharge section, wherein at least one outlet is provided in the expeller body, preferably in or adjacent the feed section of the expeller, said method comprising the step of controlling the temperature of at least the compression section of the expeller by means such that the temperature of the material within the compression section does not exceed the glass transition temperature of the seeds.

The temperature of at least the compression section may be controlled by means of a heat exchanger.

Preferably the method further comprises the step of controlling the temperature of both the compression section and the discharge section of the expeller such that the temperature of the material within the compression section does not exceed the glass transition temperature of the seeds According to a further aspect of the present invention there is provided an apparatus for pressing oilseed to extract oil therefrom, said apparatus comprising a screw press including a screw auger rotatably mounted within a cylindrical expeller body, for displacing seeds from an inlet end to an outlet end of the expeller body and compressing the seeds to extract oil therefrom, one or more oil drain outlets being provided for draining oil from the expeller body, wherein said one or more oil outlets are located at or adjacent the inlet end of the expeller body.

By locating the oil drain outlets at or adjacent the inlet end of the screw press, a higher pressure gradient is achieved within the press, providing better control of the rate of passage of the oil seed into the press. Furthermore, the extracted oil has to flow against the direction of movement of the oilseed through the expeller body to reach the one or more drain outlets, effectively filtering the oil and reducing the amount of solid material in the collected oil.

Preferably the expeller body comprises three main sections, a feed section, a compression section, and a discharge section. Preferably at least one of the one or more oil outlets are provided in the feed section of the expeller body. At least one of the one or more oil outlets may be located at an upstream end of the compression section, adjacent the feed section. Alternatively, or additionally, at least one of the one or more oil outlets may be located between the feed and compression sections.

Preferably a temperature control means is provided to control the temperature of the material within at least the compression section of the expeller body. The temperature control means preferably also controls the temperature of the material within the discharge section. The temperature control means may also be adapted to cool and/or heat the compression section of the expeller body. The temperature control means may comprise a heat exchanger in thermal contact with at least the compression section of the expeller body and preferably also the discharge section.

This is important to ensure that the glass transition temperature of the solid material within the press (known as press cake) is reached and maintained at the discharge section of the press, such that the seeds are in a brittle state in the compression section, for efficient breakage of the cell walls of the seeds resulting in efficient oil expression, and in a rubbery state in the discharge section, to prevent blockage of the discharge section. The intermolecular viscosity of the seeds solid components (e.g. cellulose, hemicellulose, lignin and proteins) changes from high to low with increases in temperature and this is reflected as a drop in the expeller pressure resulting in lower oil extraction efficiency if the temperature of the seeds is not maintained at the glass transition temperature (Tg) of the seeds during the press operation. The glass transition temperature of the seeds is inversely proportional to the moisture content of the seeds and therefore will vary from batch to batch. The glass transition temperature can vary by as much as 8° C. for every one point percentage change in the moisture content of the seeds.

Preferably an opening is provided in a side wall of the expeller body whereby seeds can be fed into the expeller body. The feed opening may be provided in an upper side of the expeller body, preferably in the feed section of the expeller body.

A feed hopper may be coupled to said feed opening for supplying seeds into the expeller body. The feed hopper may include a thermally insulating jacket or coating. Alternatively, or additionally, a temperature control means may be associated with said feed hopper for cooling or heating the contents of the feed hopper. The temperature control means may comprise a heat exchanger having a coil through which a heat exchange fluid can be passed to cool or heat the feed hopper contents, preferably according to the moisture content of the seeds contained therein.

The discharge section of the expeller body may comprise a die assembly including a die body having tapered internal walls defining a conical outlet region leading to at least one outlet opening through which press cake is extruded. Preferably the volume of the die body is a function of the swept volume of the screw auger in the compression section. In one embodiment the die volume may be approximately 15% of the swept volume of the screw auger in the compression section. Preferably the tapered internal walls of the die body are tapered at an angle of approximately 25° to the central axis of the expeller barrel. The taper angle of the internal walls of the die body may be selected to achieve said die volume. The least one outlet opening in the die body may comprise a plurality of substantially parallel elongate discharge channels arranged in an end of the die body around a central plug having a tapered outer head, outlet ends of the discharge channels opening into an outwardly facing conical seat formed in an outer end of the die body, said conical seat cooperating with the tapered head of the plug whereby an annular discharge passage is defined between the conical seat and the tapered head of the plug through which the press cake is extruded.

Preferably the plug is threadedly engaged with a threaded central hole in said end of the die body, whereby the cross sectional area of the annular discharge passage can be adjusted by screwing the threaded plug into and out of the die body, the annular discharge channel thus defining an adjustable choke whereby the flow rate of the press cake through the die assembly can be controlled.

An innermost end of the plug may be tapered to a point such that the side walls thereof deflect the press cake towards the discharge channels.

In a further aspect, the present invention provides a method of extracting oil from oilseed comprising pre-cooling seeds to a predetermined temperature and pressing the seeds within a seed press.

Preferably the seeds are cooled to a temperature below 0° C. More preferably the seeds are cooled to a temperature below −20° C.

The moisture content of the seeds may be between 8 and 14% (i.e. higher than normally accepted moisture content for pressing seeds within a seed press).

Preferably the temperature in a compression section of the seed press does not exceed 30° C.

In a further aspect the present invention provides an apparatus for pressing oilseed to extract oil therefrom, said apparatus comprising a screw press including a screw auger rotatably mounted within a cylindrical expeller body, for displacing seeds from an inlet end to an outlet end of the expeller body and compressing the seeds to extract oil therefrom, one or more oil drain outlets being provided for draining oil from the expeller body, wherein the expeller body comprises a feed section, a compression section, and a discharge section, wherein said discharge section comprises a die assembly including a die body having tapered internal walls defining a conical outlet region leading to at least one outlet opening through which press cake is extruded, wherein the volume of the die body is a function of the swept volume of the screw auger in the compression section. In one embodiment the die volume may be approximately 15% of the swept volume of the screw auger in the compression section. The tapered internal walls of the die body are tapered at an angle selected to achieve the required volume of the die body. In one embodiment the internal walls of the die body are tapered at an angle of approximately 25° to the central axis of the expeller barrel.

The at least one outlet opening may comprise a plurality of substantially parallel elongate discharge channels arranged in an end of the die body around a central plug having a tapered outer head, outlet ends of the discharge channels opening into an outwardly facing conical seat formed in an outer end of the die body, said conical seat cooperating with the tapered head of the plug whereby an annular discharge passage is defined between the conical seat and the tapered head of the plug through which the press cake is extruded.

The plug may be threadedly engaged with a threaded central hole in said end of the die body, whereby the cross sectional area of the annular discharge passage can be adjusted by screwing the threaded plug into and out of the die body, the annular discharge channel thus defining an adjustable choke whereby the flow rate of the press cake through the die assembly can be controlled.

An innermost end of the plug may be tapered to a point such that the side walls thereof deflect the press cake towards the discharge channels.

Said one or more oil outlets are located at or adjacent the inlet end of the expeller body. At least one of the one or more oil outlets is located at an upstream end of the compression section, adjacent the feed section. Alternatively, or additionally, at least one of the one or more oil outlets is located between the feed and compression sections.

BRIEF DESCRIPTION OF THE DRAWINGS

A screw press in accordance with an embodiment of the present invention will now be described, by way of example only, with reference to the accompanying drawings, in which:—

DETAILED DESCRIPTION OF THE DRAWINGS

Figure 1:
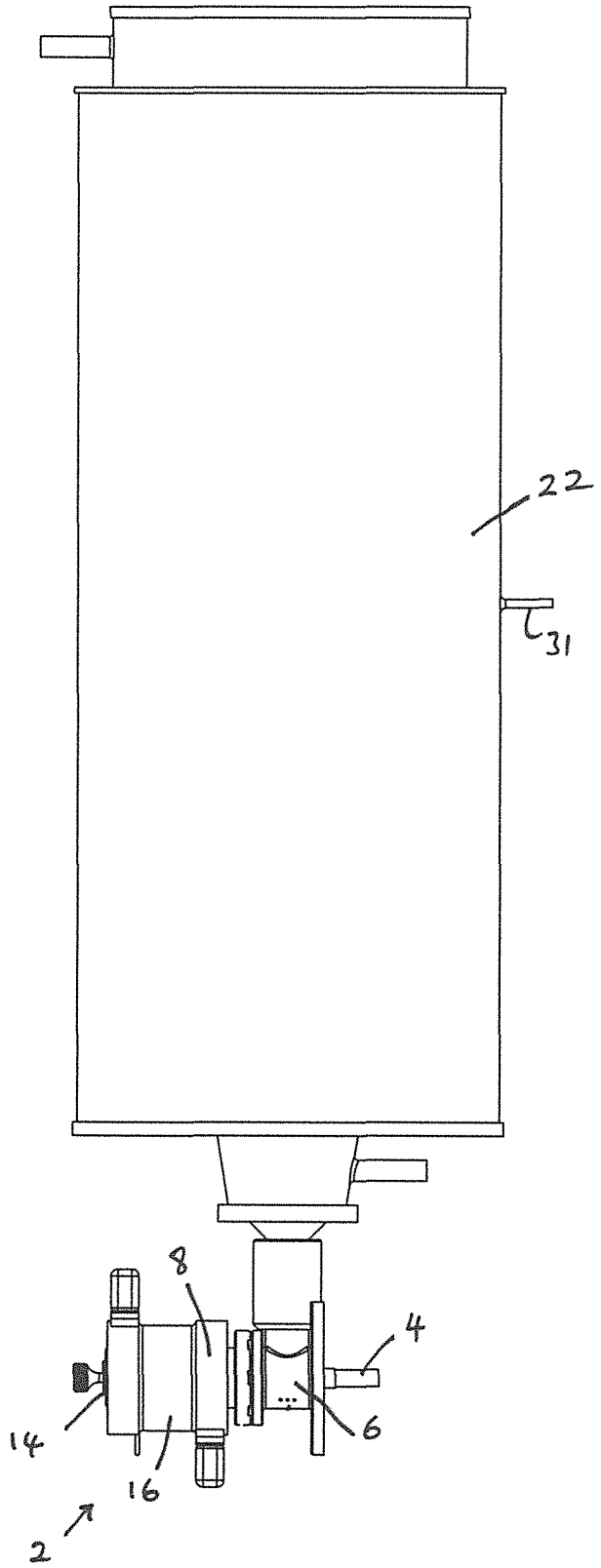
FIG. 1 is a side view of a screw press in accordance with an embodiment of the present invention.
Figure 2:
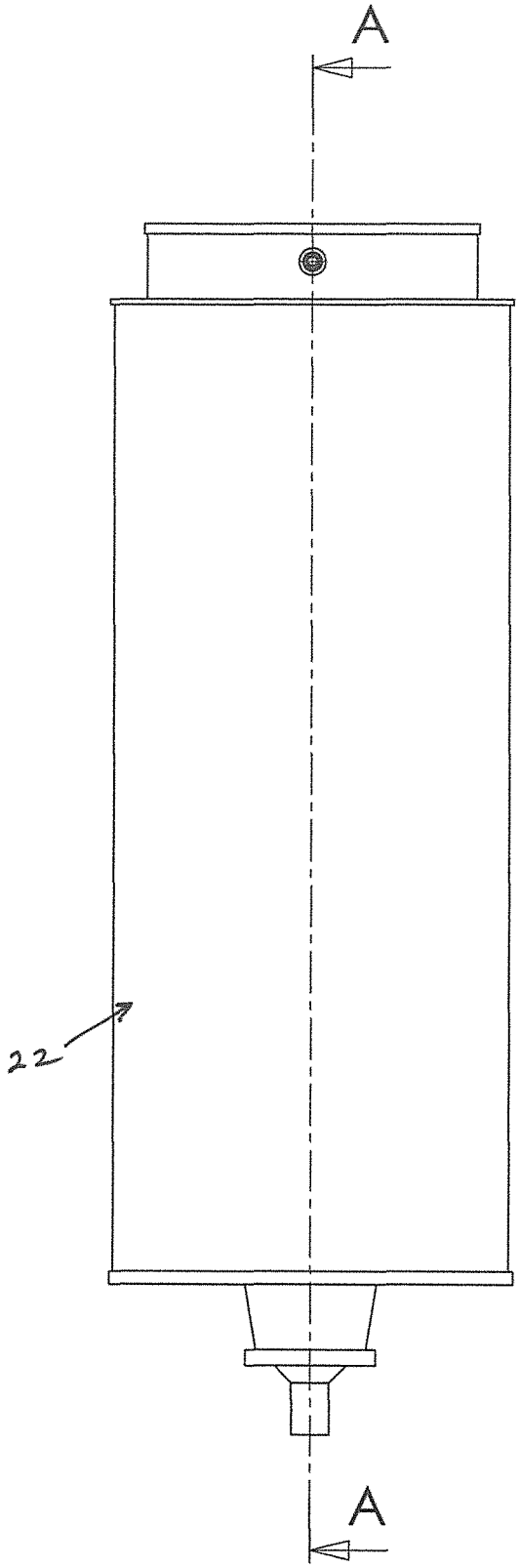
FIG. 2 is an end view of the feed hopper of the screw press of FIG. 1.

A screw press 2 for expelling oil from oil seed in accordance with an embodiment of the present invention, as illustrated in the drawings, comprises a horizontally aligned screw auger 4 rotatably mounted within a cylindrical expeller barrel 5. The expeller barrel 5 comprises axially aligned first and second sections 6,8 joined together by cooperating mating flanges 10,12. The first section 6 defines a feed section of the screw press, while the second section 8 defines a compression section of the screw press. A die assembly 14, defining a discharge section of the screw press, is attached to discharge end of the compression section 8.

The compression section 8 of the expeller barrel 5 and the die assembly 14 are surrounded by a temperature control jacket 16 incorporating a heat exchange circuit 18 through which a heat exchange fluid may be passed to control the temperature of the compression section 8 of the expeller barrel 5 and the die assembly 14, and thus the material located therein, as will be described in more detail below. This is important to ensure that the glass transition temperature of the material is only exceeded within the discharge section (die assembly 14) of the press, such that the seeds are in a brittle state in the compression section 8 for efficient oil expression and in a rubbery state within the die assembly 14 to attain optimal expeller operating pressure without blockage of the die assembly. The glass transition temperature of oilseed is dependent upon the moisture content of the seeds and therefore will vary from batch to batch.

Figure 3:
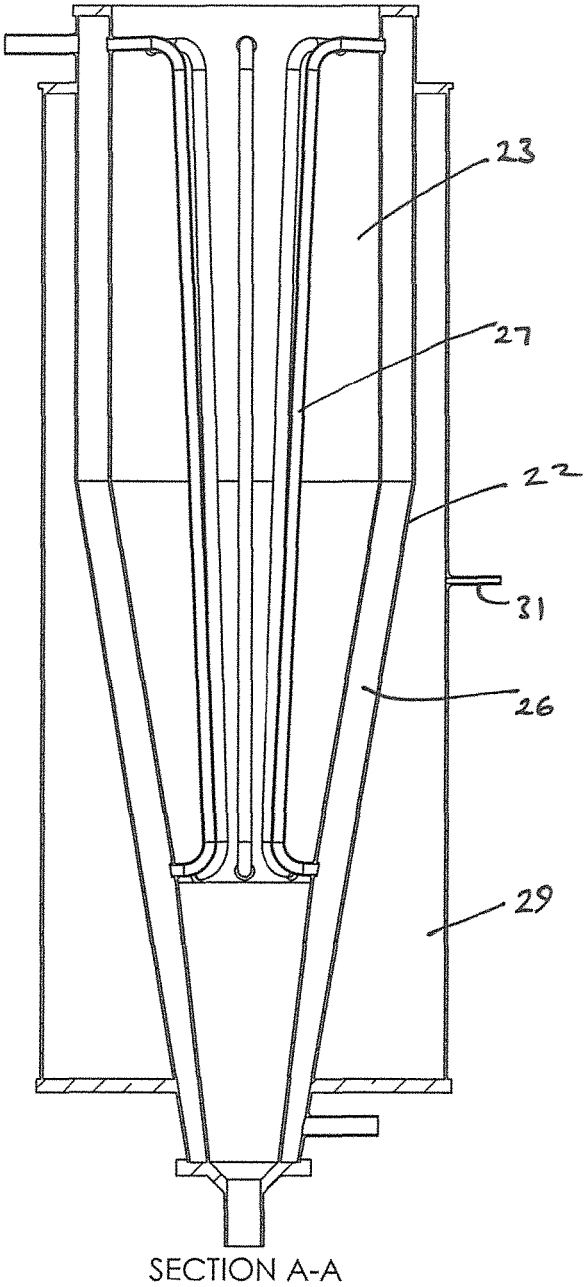
FIG. 3 is a sectional view on line A-A of FIG. 2.
Figure 4:
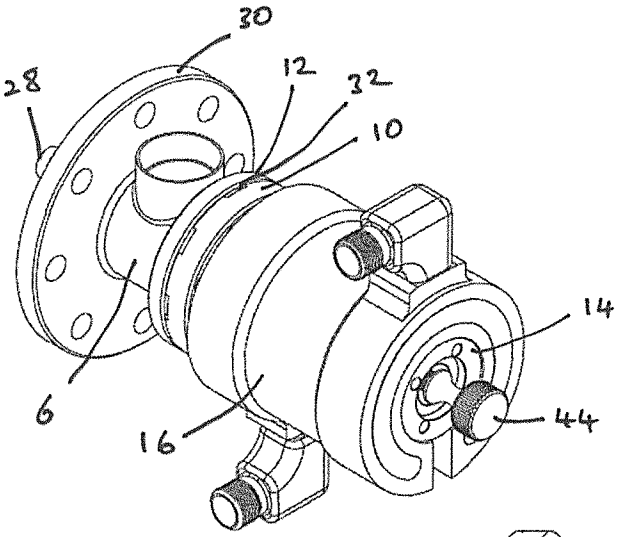
FIG. 4 is a perspective view of the seed press of FIG. 1 with the feed hopper removed for clarity.
Figure 6:
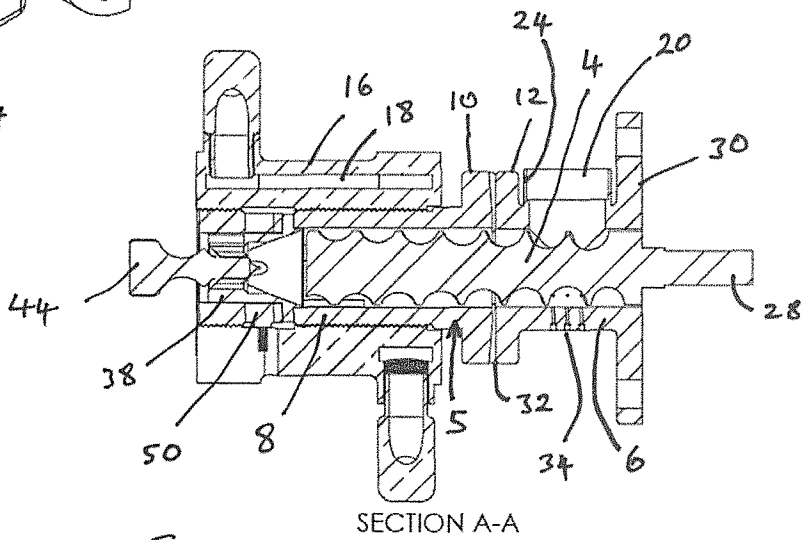
FIG. 6 is a sectional view on line A-A of FIG. 5.
Figure 5:
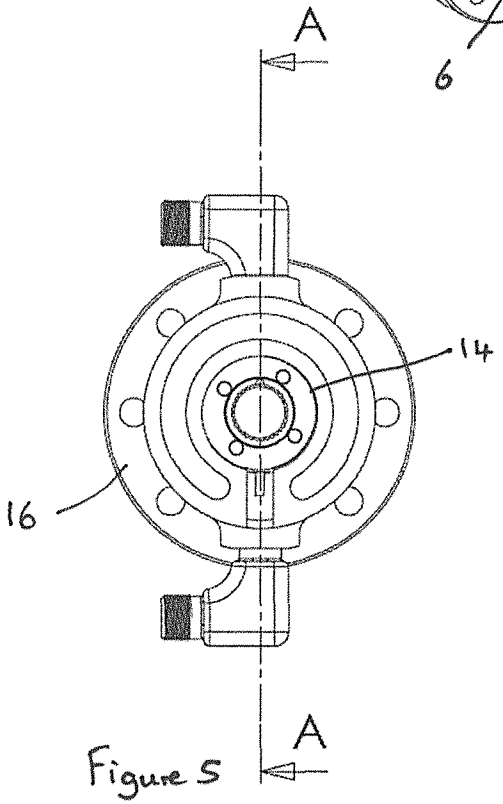
FIG. 5 is an end view of the apparatus of FIG. 4.
Figure 8:
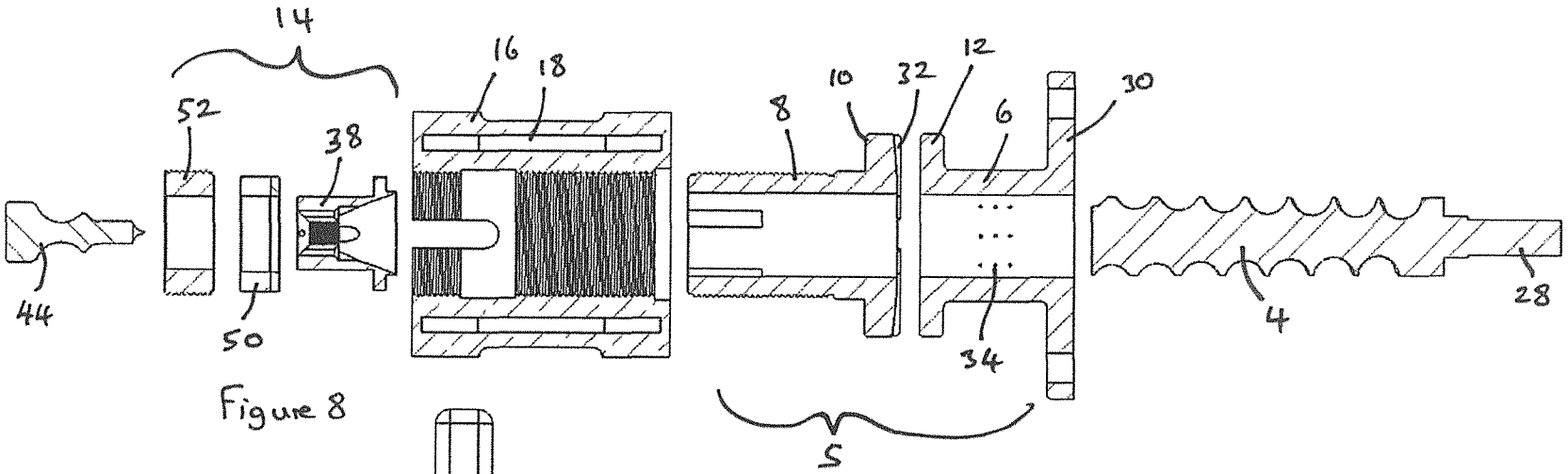
FIG. 8 is an exploded sectional view on line A-A of FIG. 7.
Figure 7:
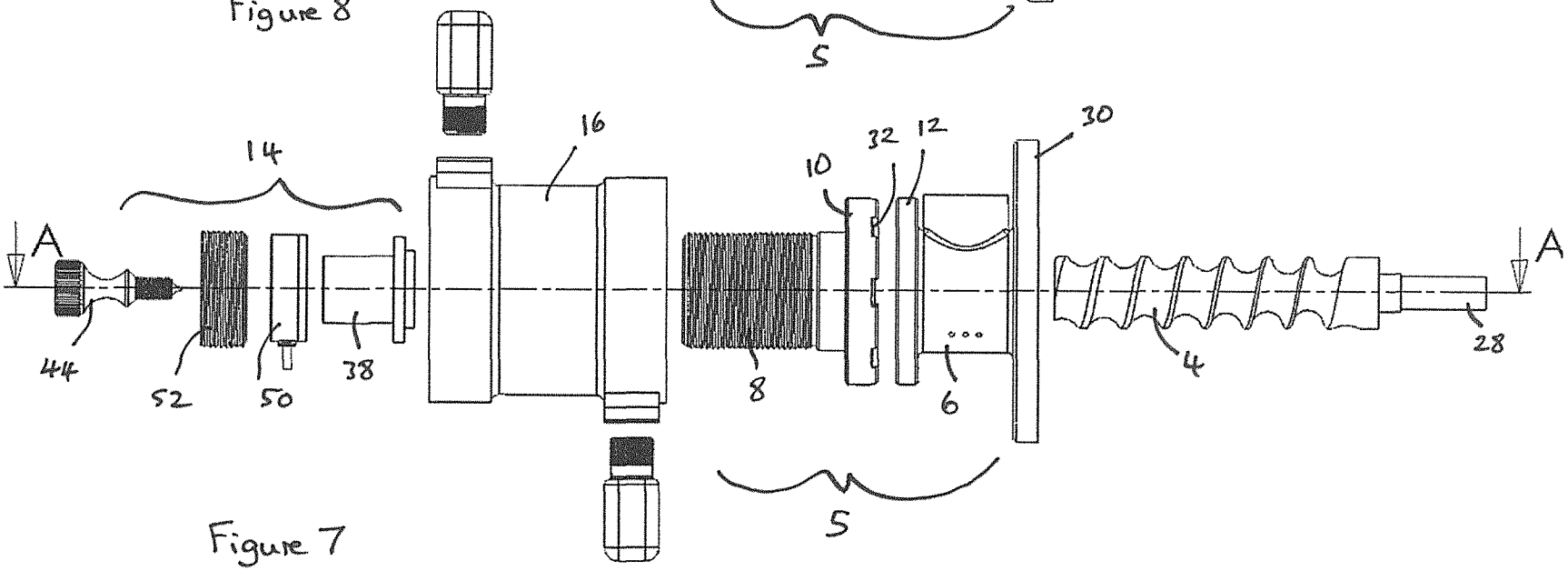
FIG. 7 is an exploded view of the screw press of FIG. 1 with the feed hopper removed.
Figure 9:
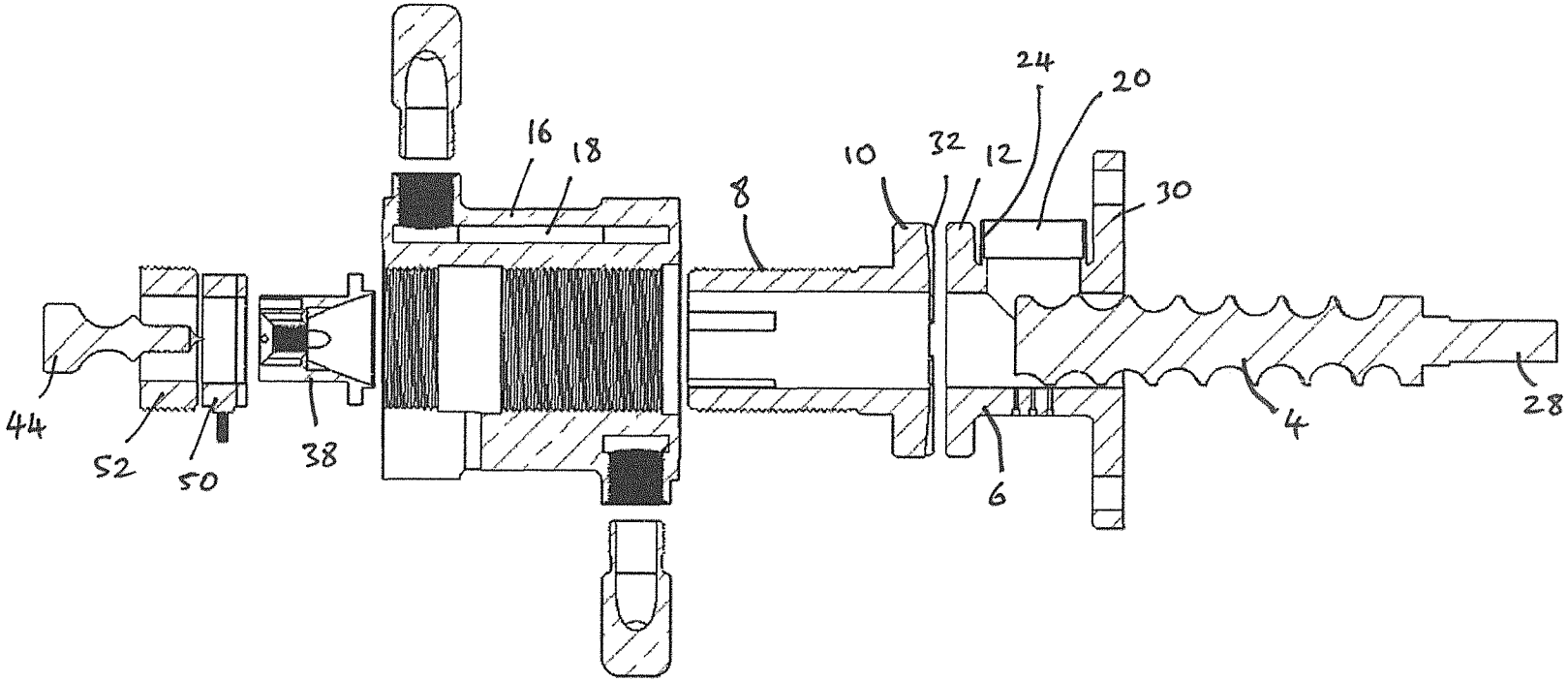
FIG. 9 is a further partly exploded longitudinal sectional view of the screw press of FIG. 1.

A vertically aligned cylindrical feed opening 20 is provided in an upper side of the feed section of the feed section 6, a feed hopper 22 being inserted into a mounting sleeve 24 at an upper end of the feed opening 20 for feeding seeds into the feed section 6 of the expeller barrel under the action of gravity. Alternatively, seeds may be fed into the feed section 6 of the expeller barrel under pressure by an auxiliary feed device. As can be seen from FIG. 3, the feed hopper 22 may comprise a tubular or conical passage 23 surrounded by a heat exchange jacket 26 through which a heat exchange fluid may be passed to control the temperature of the seeds with the feed hopper 22. Heat exchange fluid conduits 27 may also pass through the passage 23 for heating or cooling the seeds, as will be described in more detail below. A thermally insulating jacket 29 (which may be evacuated via a vacuum line 31) may be provided around the feed hopper 22.

A drive portion 28 of the screw auger 4 extends out of an open end of the feed section 6 of the expeller body 5 to be drivingly coupled to a suitable drive means, such as an electric motor. A mounting flange 30 is provided on the feed section 6 for coupling the expeller barrel 5 to a drive assembly.

As best shown in FIGS. 6 to 9, radially extending oil drain channels 32 are defined between the mating faces 10,12 the feed and compression sections 6,8 of the expeller barrel for draining oil from the expeller barrel. The oil drain channels 32 may have a width of 1.4 mm. Further oil drain holes 34 may be provided in the feed section. However, all of the oil drain channels/holes are provided closer to the feed opening 20 of the feed section 6 when compared to prior art screw presses, wherein the oil drain channels are generally provided adjacent the discharge end of the expeller. The location of the oil drain channels 32 adjacent the feed section 6 provides a higher pressure gradient within the press, providing better control of the rate of passage of the oil seed into the press. Furthermore, the extracted oil has to flow against the direction of movement of the oilseed through the expeller barrel to reach the oil drain channels 32, effectively filtering the oil and reducing the amount of solid material in the collected oil.

In compression section 8, the screw auger 4 is shaped to compress and break up the seeds to extract the oil therefrom, as is known in the art.

Figure 10:
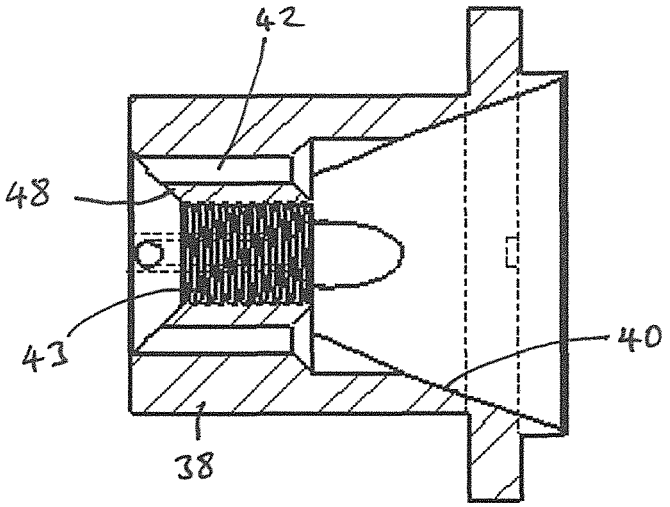
FIG. 10 is a detailed sectional view of the discharge section of the screw press of FIG. 1.
Figure 11:
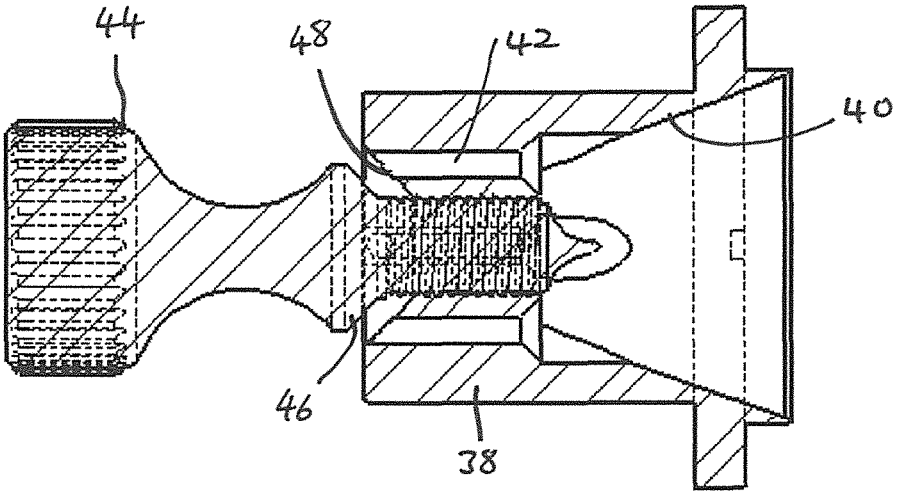
FIG. 11 is a further detailed sectional view if the discharge section of the screw press of FIG. 1 with the die adjusting screw inserted.

As best shown in FIGS. 10 and 11, the die assembly 14 defines the press cake outlet, and is formed by a die body 38 having tapered internal walls 40 defining a conical outlet region leading to a plurality of elongate discharge channels 42 arranged around a threaded central hole 43 into which is screwed a plug 44 having a tapered outer head 46. The tapered internal walls 40 of the conical outlet region of the die body 38 are preferably tapered at an angle that forms a die cavity with a volume of approximately 15% of the internal volume of the expeller barrel less the volume occupied by the auger (i.e. the volume of the screw) between the expeller fee section and the expeller barrel/die assembly interface. In the embodiment shown the walls 40 are tapered at 25° to the central axis of the expeller barrel.

The outlet ends of the discharge channels 42 open into an outwardly facing conical seat 48 cooperating with the tapered head 46 of the plug 44. An annular discharge passage is defined between the conical seat 48 and the tapered head 46 of the plug 44 through which the press cake may be extruded. The cross sectional area of such annular discharge passage may be adjusted by screwing the threaded plug 44 into and out of the die body 38, the annular discharge channel thus defining an adjustable choke whereby the flow rate of the press cake through the die assembly 14 can be controlled. An innermost end of the plug 44 comprises a point 45 for deflecting the press cake towards the discharge channels 42.

As shown in FIGS. 6 to 9, the screw press may be equipped with a pressure sensor 50, such as washer type pressure cells, preferably located at the expeller barrel/die assembly interface between the die body 38 and a threaded retaining member 52 to monitor the expeller operating pressure applied to the sensor 50 by the die body 38. The expeller barrel 5 and die body 38 temperature may be adjusted (according to the seeds moisture content) by cooling or heating in order to maintain the press cake at or just below its glass transition temperature (Tg) within the compression section 8 of the screw press 2. If the pressure within the compression section drops below the optimum operating pressure, which is achievable when the press cake is at or just below the glass transition temperature, the expeller barrel and die assembly should be cooled. If the pressure increases above the optimum operating value, the expeller barrel and die should be heated accordingly (in order to maintain the press cake at or just below its glass transition temperature within the compression section).

During operation of the expeller a column or plug of compressed meal (press cake) is formed in the die assembly 14 of the expeller, while new seed material is rammed into the compression section 8 by the action of the screw auger 4 in the feed section 6. New cake is constantly formed within the tapered walls 40 the die assembly 14 as the press cake is constantly discharged through the discharge channels 42. The operation may proceed continuously by a constant addition of seed material to the feed opening 20 of the feed section 6 from the feed hopper 22.

The shape of the screw auger 4 is designed in a way to be able to cause a higher volume displacement at the feed section 6 compared to the volume displacement at the compression section 8. The seed material is subject to increasing axial and radial pressure as it is conveyed through the compression section 8 and the resulting pressure causes the oil to be expelled from the oilseed cells. The expelled oil flows against the seeds towards the feed section 6 and exits the expeller barrel via the discharge channels 32 (and through the further drain holes 34 where provided).

In use, oil seed is loaded into the feed hopper 22 and the auger 4 is driven such that the seed is fed into the feed section 4 of the expeller barrel via the flights of the screw auger 4 and into the compression section 8, wherein the seeds are compressed. The seeds then pass into the die body 38, building up pressure in the expeller barrel. At the same time, a heat exchange fluid may be passed through the heat exchange circuit 18 of the temperature control jacket 16 to control the temperature of the material within the compression section 8 and the die body 38 and/or into the heat exchange jacket 26 of the feed hopper 22 to control the temperature of the seeds in the feed hopper 22. Suitable temperature sensors may be provided on the compression section 8 of the expeller barrel and/or the die body 38 of the die assembly 14 and on the feed hopper 22 to provide feedback for the temperature control means.

Once a plug of press cake has built up within the die body 38, a pressure gradient is created down the length of the expeller barrel and oil begins to be expelled from the seeds and flows against the direction of movement of the seeds trough the press to reach the oil drain channels 32, through which the oil drains to be collected is a suitable collection vessel located therebeneath.

Controlling the temperature of the material within the compression section 8 and the die body 38, by means of the temperature control jacket 16, ensures that the glass transition temperature of the material is reached in the die body 38, such that the seeds are in a brittle state in the compression section for efficient oil expression and in a rubbery state at the die to help avoid blockage of the die assembly 14. The glass transition temperature will vary in dependence upon the moisture content of the seeds, and thus the operating temperature of the screw press, in particular in the compression section 8 thereof, will need to be adjusted by means of the temperature control jacket 16 to suit the moisture content of the seeds being processed.

An important factor in terms of the quality of the oil for use as a fuel is the phospholipids content of the oil. This increases as a function of the temperature of the oil in the compression zone of the press. In the prior art, downstream processes have been required to reduce the phospholipid content of the oil after expression from the seeds. By controlling the temperature of the material within the compression zone beneficial results can be obtained.

Furthermore, the inventor has been able to produce oil with a much lower phospholipid content by pre-cooling (freezing) the seeds to a low temperature before they are placed in the press so that the temperature reached in the compression zone is much lower than in prior art presses. For example cooling the seeds to approximately −25° C. results in a temperature at the downstream end of the compression section of approximately 28° C. To ensure that the glass transition temperature of the press cake is reached at the die body 38, the oilseeds are pressed with moisture content well above the usually preferred 5% (for example 8-14%) so that the glass transition temperature is lowered to suit the lower operating temperature of the press when the seeds are cooled in this manner. The provision of a heat exchange coil 26 around the feed hopper 22, in addition to a thermally insulating jacket, can ensure that the seeds remain at the required low temperature when in the feed hopper 22. Such process is capable of producing oil with a phosphorus content of less than 3 ppm and calcium and magnesium contents of around 1 ppm.

Experiments have been carried out with seeds frozen in a chest freezer, frozen using dry ice, flash frozen using CO2 (using a modified fire extinguisher) and flash frozen combined with dry ice storage (to achieve extreme cryo-press conditions). Seeds were also pressed with mixed dry ice. Flash freezing (by CO2 expansion) was the fastest way to freeze seeds. The seeds temperature dropped from ambient temperature to around −27° C. in less than a minute when flash frozen using a modified CO2 fire extinguisher.

Based on experiments results and research, the following preferred seed freezing process is envisaged.

Seeds with moisture content between 7% and 9% are batch loaded in a high porosity basket inside a high pressure vessel, hereafter referred to as supercritical CO2 impregnation vessel. CO2 at supercritical state is then injected in the impregnation vessel and it is maintained at supercritical conditions for a required period for the seeds to be impregnated with the supercritical CO2. After the impregnation period, the CO2 impregnation vessel is flash decompressed and the seeds are immediately loaded into the expeller hopper for pressing.

Carbon dioxide at supercritical state has properties midway between a gas and a liquid. It can expand to fill its container like a gas but with a density of a liquid. It can be expected that during the impregnation stage the CO2 will reach the interior of the seeds and its expansion during flash decompression should cause substantial damage to the seeds cell walls in addition to flash freezing. The expected cell wall damage should help to further improve the oil expression efficiency of the expeller at Cryo-press conditions.

A second injection of CO2, if necessary for further cooling of the seeds, can then be done by using carbon dioxide direct from a reservoir tank (not at supercritical state).

The expeller hopper heat exchanger is preferably of a capacity of size to maintain the seeds temperature at or below the temperature achieved by the CO2 expansion from the impregnating vessel.

Vegetable oils have been extracted in the past by Supercritical CO2. The process is based on the solubility of vegetable oils in supercritical CO2 and requires mechanical pre-treatment to break the seeds to an optimal particle sizes. The process does not involve flash decompression and the seeds are not subsequently pressed. Traditional supercritical CO2 process is in essence a high pressure solvent extraction, it is very slow compared to mechanical extraction and also difficult to be scaled up.

The proposed seed freezing process differs from supercritical CO2 extraction because the supercritical CO2 is used not as a solvent but as a cooling agent able to penetrate the seeds structure in order to cause cell wall damage and freezing during flash decompression of the impregnating vessel.

The invention is not limited to the embodiment(s) described herein but can be amended or modified without departing from the scope of the present invention.

The invention claimed is:

1. A method of extracting oil from oilseed comprising pressing seeds within a screw press including a screw auger rotatably mounted within a cylindrical expeller body, the expeller body comprising a feed section, a compression section, and a discharge section, the discharge section being defined by a die body having tapered internal walls leading to at least one outlet opening, one or more oil drain channels being provided in or adjacent the feed section of the expeller body, the method comprising the step of:

controlling a temperature of at least the compression section of the expeller body by means of a heat exchanger in thermal contact with at least the compression section as a function of a pressure within the expeller body as determined by a pressure sensor located between the die body and a retaining member to monitor an expeller body operating pressure applied to the sensor by the die body and to detect a change in a state of the seeds from a brittle state to a rubbery state that occurs at a glass transition temperature of the seeds, and to maintain a temperature of a material within the compression section below the glass transition temperature (Tg) of the seeds.

2. The method of claim 1, wherein the one or more oil drain channels are provided between the feed and compression sections of the expeller body.

3. The apparatus of claim 1, wherein at least one of the one or more oil drain channels is located at an upstream end of the compression section, adjacent the feed section.

4. The apparatus of claim 1, wherein at least one of the one or more oil drain channels is located between the feed and compression sections.

5. The apparatus of claim 1, wherein the heat exchanger is adapted to do at least one from the group consisting of cool and heat the compression section of the expeller body.

6. The apparatus of claim 5, wherein the heat exchanger is configured to do at least one from the group consisting of cool and heat the discharge section of the expeller body.

7. The apparatus of claim 5, wherein a feed opening is provided in a side wall of the expeller body and seeds can be fed into the expeller body.

8. The apparatus of claim 7, wherein the feed opening is provided in an upper side of the expeller body.

9. The apparatus of claim 7, wherein the feed opening is provided in the feed section of the expeller body.

10. The apparatus of claim 9, wherein a temperature control device is associated with a feed hopper for heating or cooling the contents of the feed hopper.

11. The apparatus of claim 10, wherein the temperature control device comprises a further heat exchanger having a coil through which a heat exchange fluid can be passed to heat or cool the feed hopper.

12. The apparatus of claim 7, wherein a feed hopper is coupled to the feed opening for supplying seeds into the expeller body.

13. The apparatus of claim 12, wherein the feed hopper includes a thermally insulating jacket or coating.

14. An apparatus for pressing oilseed to extract oil therefrom, the apparatus comprising:

a screw press including a screw auger rotatably mounted within a cylindrical expeller body for displacing seeds from an inlet end to an outlet end of the expeller body and compressing the seeds to extract oil therefrom; and one or more oil drain channels being provided in or adjacent a feed section of the expeller body for draining oil from the expeller body, where the one or more oil drain channels are located at or adjacent the inlet end of the expeller body, the expeller body comprising the feed section, a compression section, and a discharge section, the discharge section being defined by a die body having tapered internal walls leading to at least one outlet opening; and, a heat exchanger in thermal contact with at least the compression section being provided to control a temperature of a material within at least the compression section of the expeller body, a pressure sensor being located between the die body and a retaining member monitors an expeller operating pressure applied to the sensor by the die body and detects a change in a state of the seeds from a brittle state to a rubbery state that occurs at a glass transition temperature of the seeds, and maintains a temperature of the material within the compression section below a glass transition temperature (Tg) of the seeds.

15. The apparatus of claim 14, wherein the tapered internal walls of the die body having a taper angle and defining a conical outlet region leading to the at least one outlet opening through which press cake is extruded.

16. The apparatus of claim 15, wherein a volume within the die body is a function of a swept volume of the screw auger in the compression section.

17. The apparatus of claim 16, wherein the volume within the die body is approximately 15% of the swept volume of the screw auger in the compression section.

18. The apparatus of claim 16, wherein the taper angle of the internal walls of the die body is selected to achieve the volume within the die body.

19. The apparatus of claim 18, wherein the taper angle of the internal walls of the die body is approximately 25° to the central axis of the expeller body.

20. The apparatus of claim 15, wherein the at least one outlet opening of the die body comprises a plurality of substantially parallel elongate discharge channels arranged in an end of the die body around a central plug having a tapered outer head, outlet ends of the discharge channels opening into an outwardly facing conical seat formed in an outer end of the die body, the conical seat cooperating with the tapered head of the plug, an annular discharge passage is defined between the conical seat and the tapered head of the plug through which the press cake is extruded.

21. The apparatus of claim 20, wherein the plug is threadedly engaged with a threaded central hole in the end of the die body, the cross sectional area of the annular discharge passage can be adjusted by screwing the threaded plug into and out of the die body, the annular discharge passage thus defining an adjustable choke, the flow rate of the press cake through the die assembly can be controlled.

22. The apparatus of claim 20, wherein an innermost end of the plug is tapered to a point such that the side walls thereof deflect the press cake towards the discharge channels.

23. An apparatus for pressing oilseed to extract oil therefrom, the apparatus comprising:

a screw press including a screw auger, rotatably mounted within a cylindrical expeller body, for displacing seeds from an inlet end to an outlet end of the expeller body and compressing the seeds to extract oil therefrom; and one or more oil drain channels being provided for draining oil from the expeller body, the expeller body comprising:

a feed section;

a compression section; and a discharge section, the discharge section comprising:

a die assembly including a die body having tapered internal walls having a taper angle and defining a conical outlet region leading to at least one outlet opening through which press cake is extruded, where a volume within the die body is a function of a swept volume of the screw auger in the compression section;

a pressure sensor being located between the die body and a retaining member monitors an expeller operating pressure applied to the sensor by the die body; and a temperature control device provided to control a temperature of a material within at least the compression section of the expeller body as a function of a pressure within the expeller body as determined by the pressure sensor located between the die body and the retaining member monitors applied to the sensor by the die body and detects a change in a state of the seeds from a brittle state to a rubbery state that occurs at a glass transition temperature of the seeds, and maintains a temperature of the material within the compression section below the glass transition temperature (Tg) of the seeds.

24. The apparatus of claim 23, wherein the volume within the die body is approximately 15% of the swept volume of the screw auger in the compression section.

25. The apparatus of claim 23, wherein the taper angle of the internal walls of the die body is selected to achieve the volume within the die body.

26. The apparatus of claim 25, wherein the taper angle of the internal walls of the die body is approximately 25° to the central axis of the expeller body.

27. The apparatus of claim 23, wherein the at least one outlet opening of the die body comprises a plurality of substantially parallel elongate discharge channels arranged in an end of the die body around a central plug having a tapered outer head, outlet ends of the discharge channels opening into an outwardly facing conical seat formed in an outer end of the die body, the conical seat cooperating with the tapered head of the plug where an annular discharge passage is defined between the conical seat and the tapered head of the plug through which the press cake is extruded.

28. The apparatus of claim 27, wherein the plug is threadedly engaged with a threaded central hole in the end of the die body, the cross sectional area of the annular discharge passage can be adjusted by screwing the threaded plug into and out of the die body, the annular discharge passage thus defining an adjustable choke, the adjustable choke configured to control the flow rate of the press cake through the die assembly.

29. The apparatus of claim 27, wherein an innermost end of the plug is tapered to a point such that the side walls thereof deflect the press cake towards the discharge channels.

30. The apparatus of claim 29, wherein at least one of the one or more oil drain channels is located at an upstream end of the compression section, adjacent the feed section.

31. The apparatus of claim 27, wherein the one or more oil drain channels are located at or adjacent the inlet end of the expeller body.

32. The apparatus of claim 31, wherein at least one of the one or more oil drain channels is located between the feed and compression sections.

* * * * *